US009425558B1

(12) United States Patent
Hsu et al.

(10) Patent No.: US 9,425,558 B1
(45) Date of Patent: Aug. 23, 2016

(54) ELECTRICAL CONNECTOR HAVING AN OUTER SHIELDING COVERED BY A COVER WITH A RESILIENT PLATE EXTENDING UPWARD AND REARWARD

(71) Applicant: Cheng Uei Precision Industry Co., Ltd., New Taipei (TW)

(72) Inventors: Li-Nien Hsu, New Taipei (TW); Chih-Lin Yang, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/919,732

(22) Filed: Oct. 22, 2015

(51) Int. Cl.
*H01R 13/648* (2006.01)
*H01R 13/6581* (2011.01)
*H01R 12/71* (2011.01)

(52) U.S. Cl.
CPC ..... *H01R 13/6581* (2013.01); *H01R 12/71* (2013.01)

(58) Field of Classification Search
CPC ..... H01R 13/648; H01R 13/658; H01R 13/65802; H01R 13/6581; H01R 13/6582; H01R 13/44; H01R 13/447; H01R 13/506
USPC ..... 439/607.07, 607.09, 607.27
See application file for complete search history.

(56) References Cited

U.S. PATENT DOCUMENTS 4,592,612 A * 6/1986 Kikuta ..... H01R 13/65802 439/607.47
5,435,744 A * 7/1995 Derstine ..... H01R 13/5045 439/352
6,203,336 B1 * 3/2001 Nakamura ..... H01R 13/64 439/607.42
6,599,151 B2 * 7/2003 Chiran ..... H01R 13/506 439/607.48
7,001,249 B1 * 2/2006 Pride ..... B24B 9/102 451/190
7,438,590 B1 * 10/2008 Liang ..... H01R 12/592 439/495
2005/0277332 A1 * 12/2005 Chen ..... H01R 13/6594 439/607.01
2009/0068890 A1 * 3/2009 Horiuchi ..... H01R 4/20 439/607.41
2010/0233905 A1 * 9/2010 Nagata ..... H01R 12/724 439/607.13
2013/0178100 A1 * 7/2013 Nagata ..... H01R 13/6594 439/607.35
2015/0263457 A1 * 9/2015 Miyoshi ..... H01R 13/6581 439/607.27

* cited by examiner

*Primary Examiner* — Chandrika Prasad
(74) *Attorney, Agent, or Firm* — Cheng-Ju Chiang

(57) ABSTRACT

An electrical connector includes a main body, a plurality of terminals fastened to the main body, an outer shielding shell surrounding the main body together with the terminals, and a cover covered outside the outer shielding shell. The main body is mounted to a circuit board. Rear ends of the terminals are mounted to the circuit board. Front ends of the terminals are exposed out of the main body. A rear end of the cover defines a resilient plate. A rear edge of the resilient plate is bent perpendicular to the resilient plate to form a rear plate. The resilient plate is separably mounted to an outside of the outer shielding shell to make the rear plate disposed behind or above the main body and the outer shielding shell.

17 Claims, 12 Drawing Sheets

ELECTRICAL CONNECTOR HAVING AN OUTER SHIELDING COVERED BY A COVER WITH A RESILIENT PLATE EXTENDING UPWARD AND REARWARD

BACKGROUND OF THE INVENTION

1. Field of the Invention

The present invention generally relates to a connector, and more particularly to an electrical connector.

2. The Related Art

A conventional electrical connector includes an insulating housing, a plurality of terminals and a shielding shell. The insulating housing defines an assembling opening penetrating through a rear of a bottom of the insulating housing. A tail end of each of the terminals defines a soldering portion. The shielding shell has a rear plate. The terminals are assembled to the insulating housing. The soldering portion of each of the terminals projects into the assembling opening and is soldered to a circuit board by a surface mount technology. The shielding shell is fastened to the insulating housing. The rear plate is fastened behind the insulating housing and the soldering portion.

However, if a soldering problem of the conventional electrical connector is generated after the soldering portion is soldered to the circuit board, the electrical connector is hardly reworked on account of the shielding shell being fastened to the insulating housing and the rear plate being fastened behind the insulating housing and the soldering portion. As a result, a defect rate of the electrical connector is higher and a manufacturing cost of the electrical connector is increased.

Thus, it is essential to provide an innovative electrical connector which is capable of being reworked, so that a defect rate of the electrical connector is lower and a manufacturing cost of the innovative electrical connector is decreased.

SUMMARY OF THE INVENTION

An object of the present invention is to provide an electrical connector for being mounted to a circuit board. The electrical connector includes a main body, a plurality of terminals, an outer shielding shell and a cover. The main body is mounted to the circuit board. The terminals are fastened to the main body and are arranged transversely. Rear ends of the terminals are mounted to the circuit board, and front ends of the terminals are exposed out of the main body. The outer shielding shell surrounds the main body together with the terminals. A front end of the main body is spaced from an inner surface of a front end of the outer shielding shell to form an insertion space between the front end of the main body and the front end of the outer shielding shell. The cover is covered outside the outer shielding shell. A rear end of the cover defines a resilient plate slantwise extending upward and rearward. A rear edge of the resilient plate is bent perpendicular to the resilient plate to form a rear plate. The resilient plate is separably mounted to an outside of the outer shielding shell to make the rear plate disposed behind or above the main body and the outer shielding shell.

As described above, the cover is covered outside the outer shielding shell, the rear end of the cover defines the resilient plate slantwise extending upward and rearward, and the rear plate is disposed behind the main body and the outer shielding shell, if a soldering problem of the electrical connector is generated, the resilient plate is tilted upward by virtue of the elastic force, the rear plate moves upward to be located above the main body and the outer shielding shell, so that the electrical connector is capable of being reworked. As a result, a defect rate of the electrical connector is lower and a manufacturing cost of the electrical connector is decreased.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
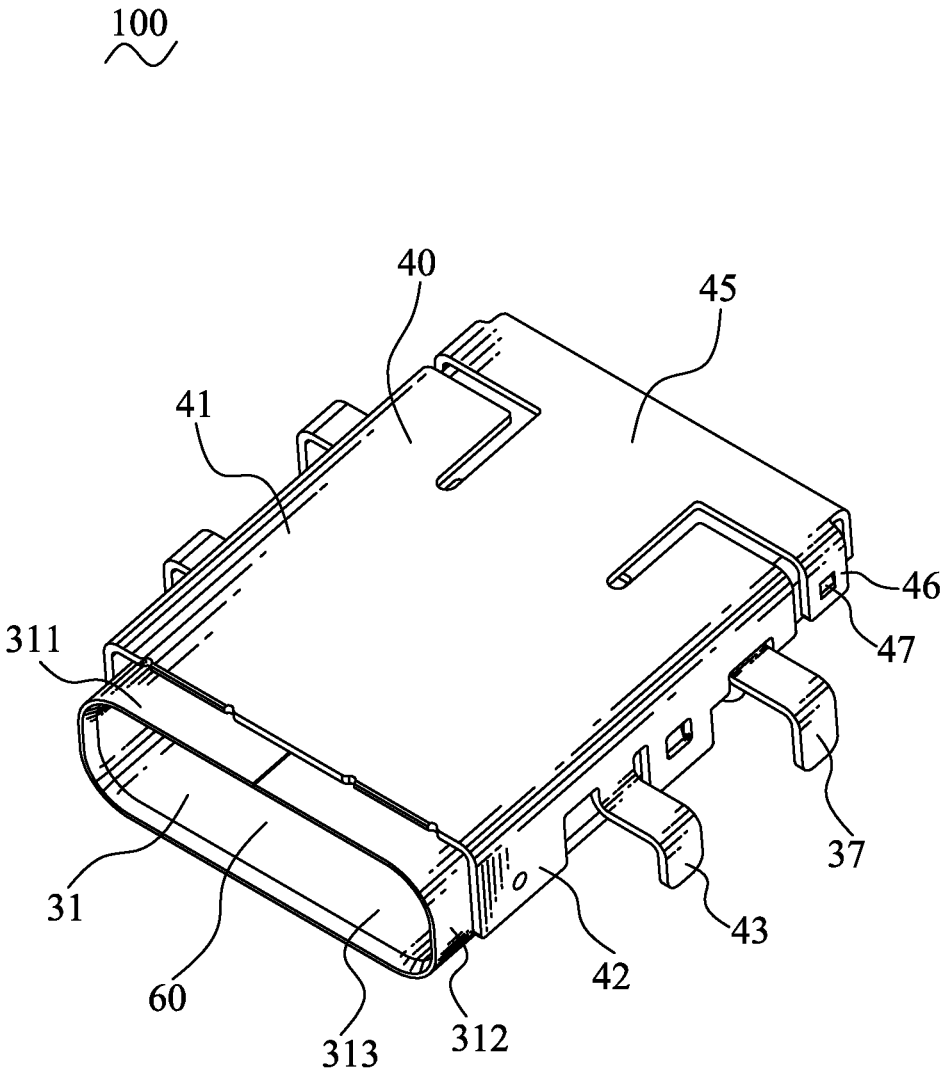
FIG. 1 is a perspective view of an electrical connector in accordance with the present invention.
Figure 2:
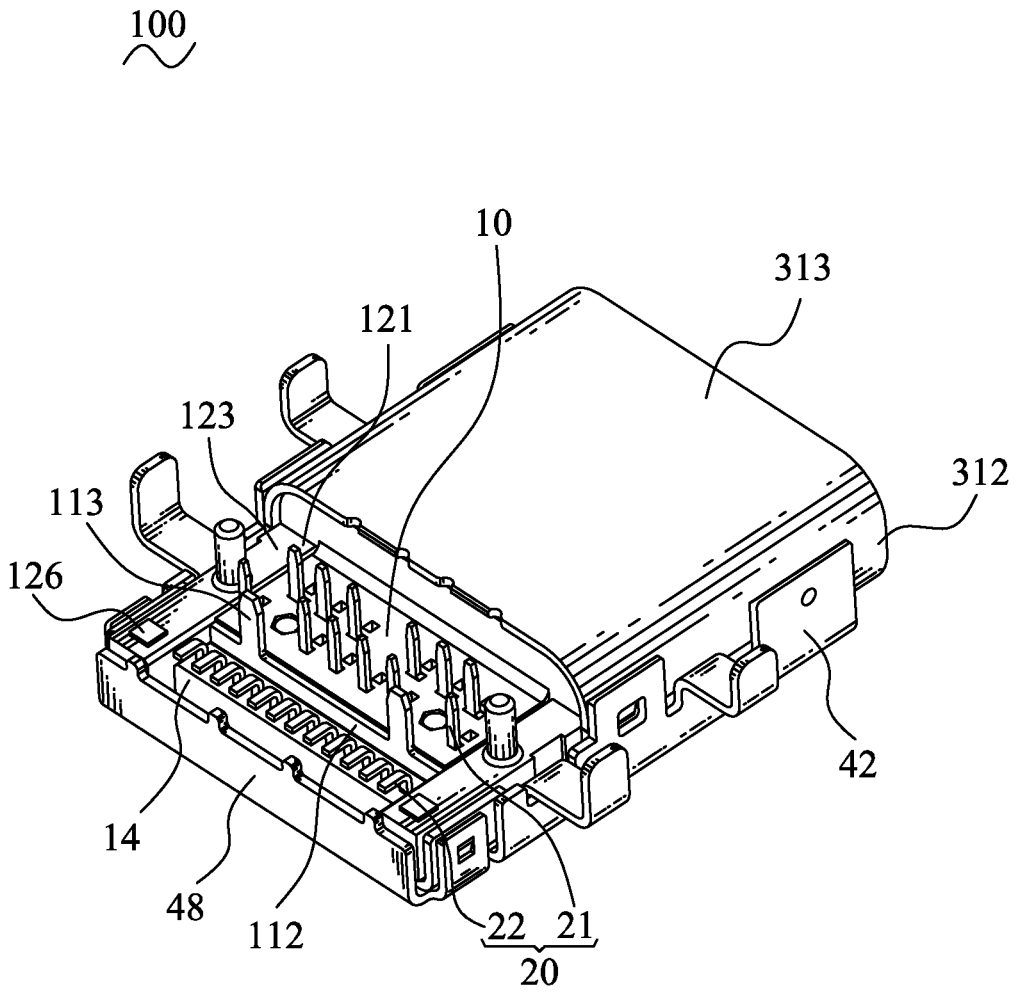
FIG. 2 is another perspective view of the electrical connector of FIG. 1.

With reference to FIG. 1 to FIG. 4, an electrical connector 100 in accordance with the present invention is shown. The electrical connector 100 for being mounted to a circuit board (not shown), includes a main body 10, a plurality of terminals 20, an outer shielding shell 30 and a cover 40.

Figure 3:
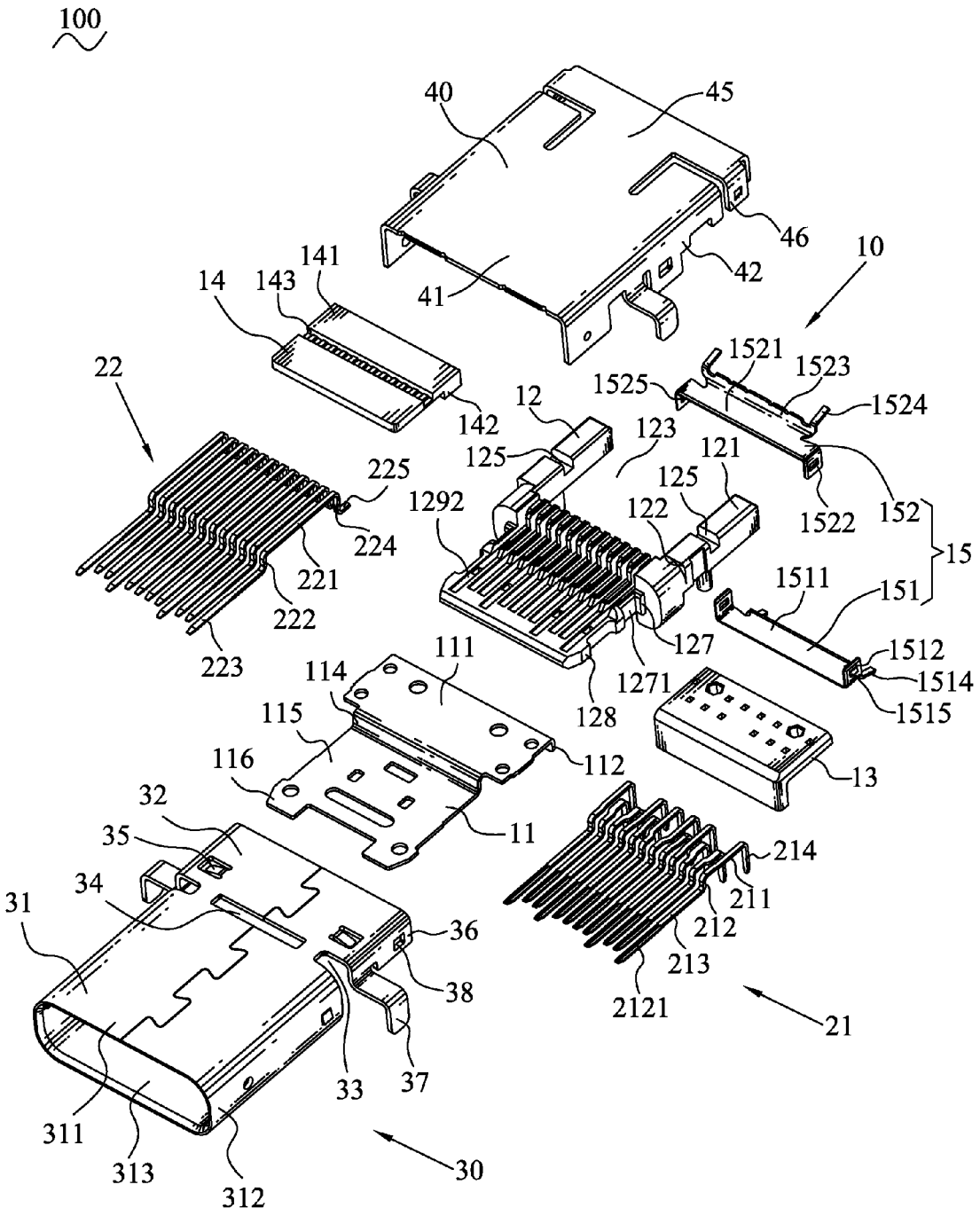
FIG. 3 is an exploded view of the electrical connector of FIG. 1.

Referring to FIG. 3, the main body 10 includes a middle shielding component 11, a base body 12, a first dielectric body 13 and a second dielectric body 14.

Figure 4:
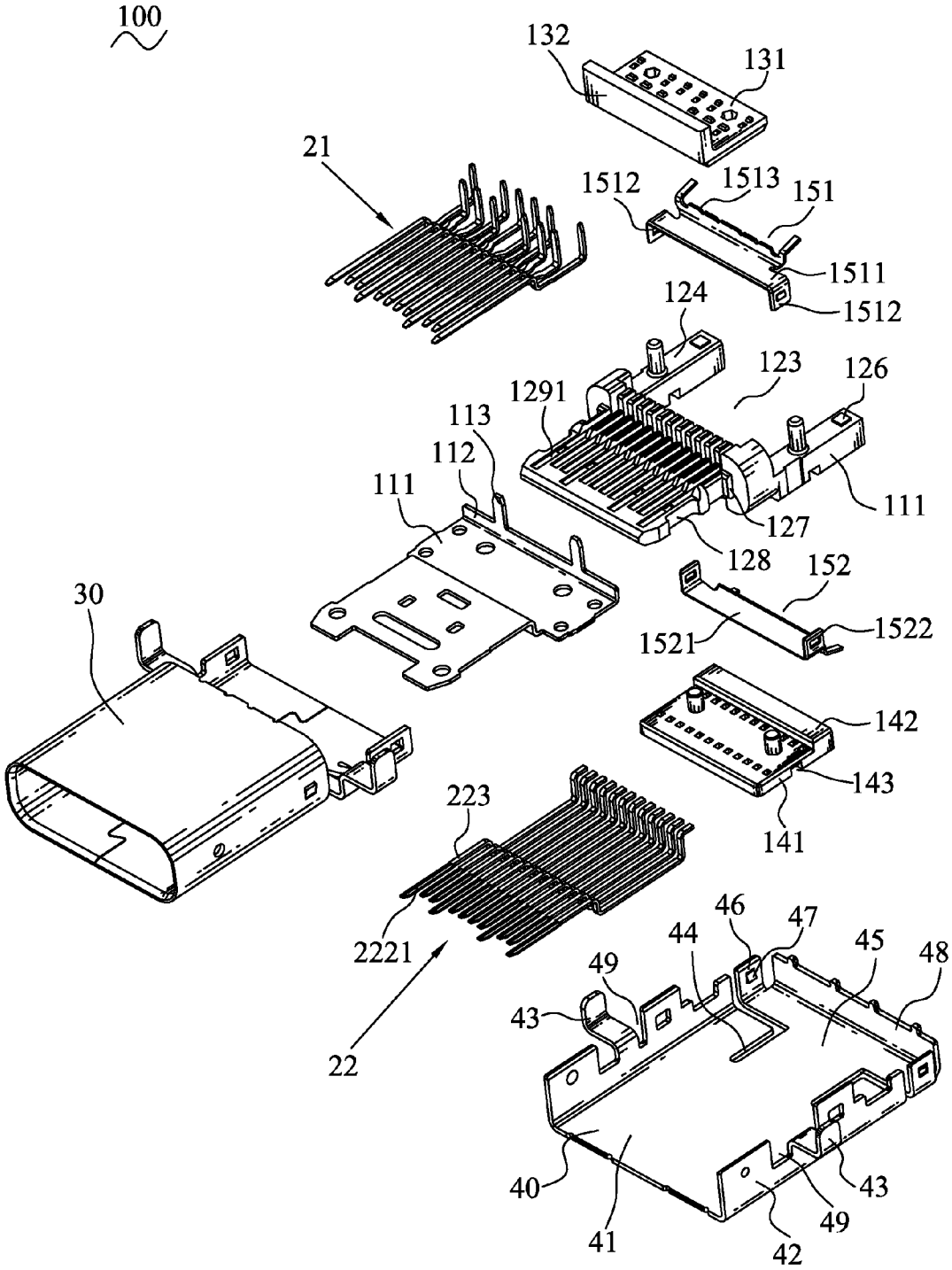
FIG. 4 is another exploded view of the electrical connector of FIG. 1.
Figure 5:
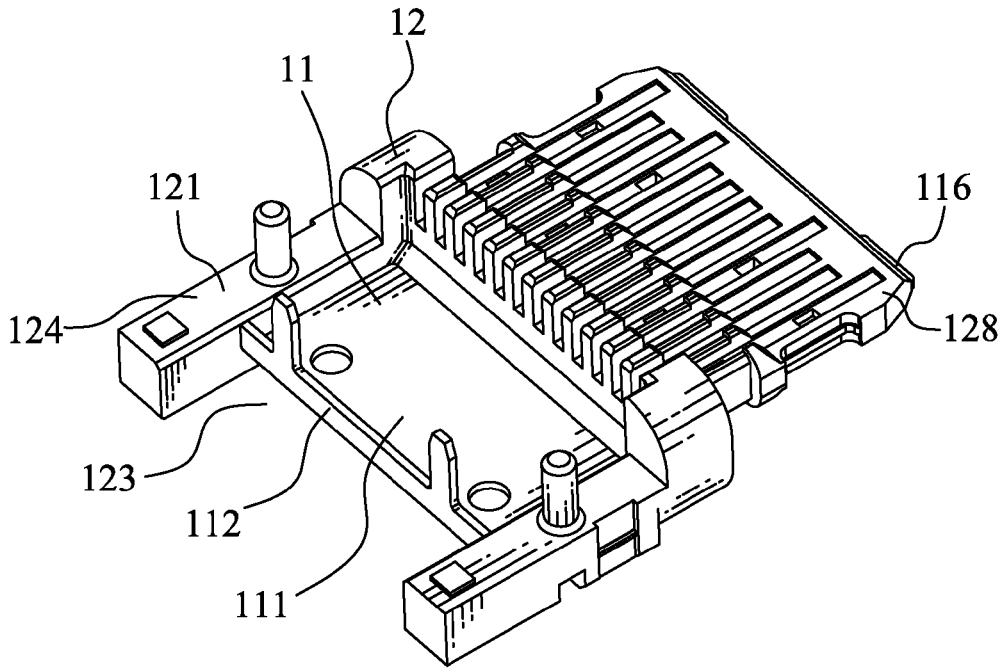
FIG. 5 is a partially perspective view showing that a middle shielding plate is molded to an insulating housing of the electrical connector of FIG. 1.
Figure 6:
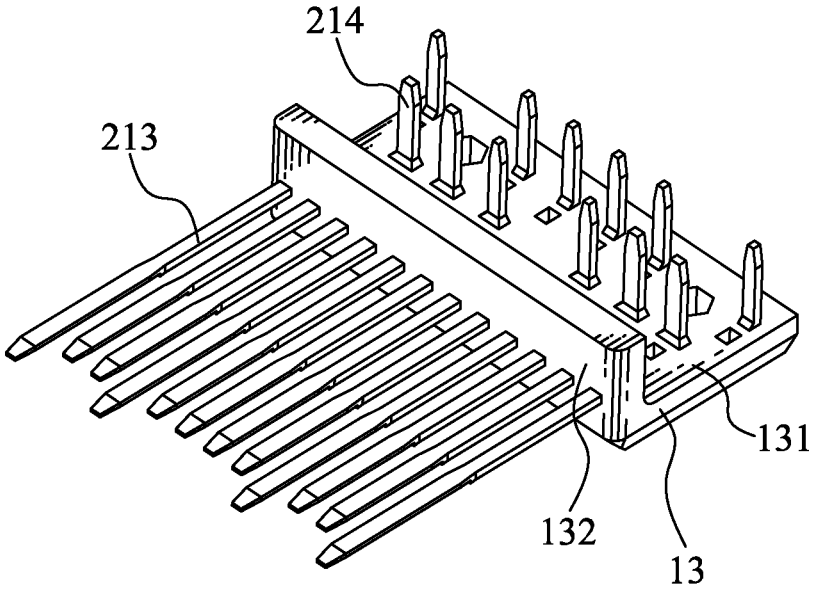
FIG. 6 is a partially perspective view showing that first terminals are molded to a first dielectric body of the electrical connector of FIG. 1.
Figure 7:
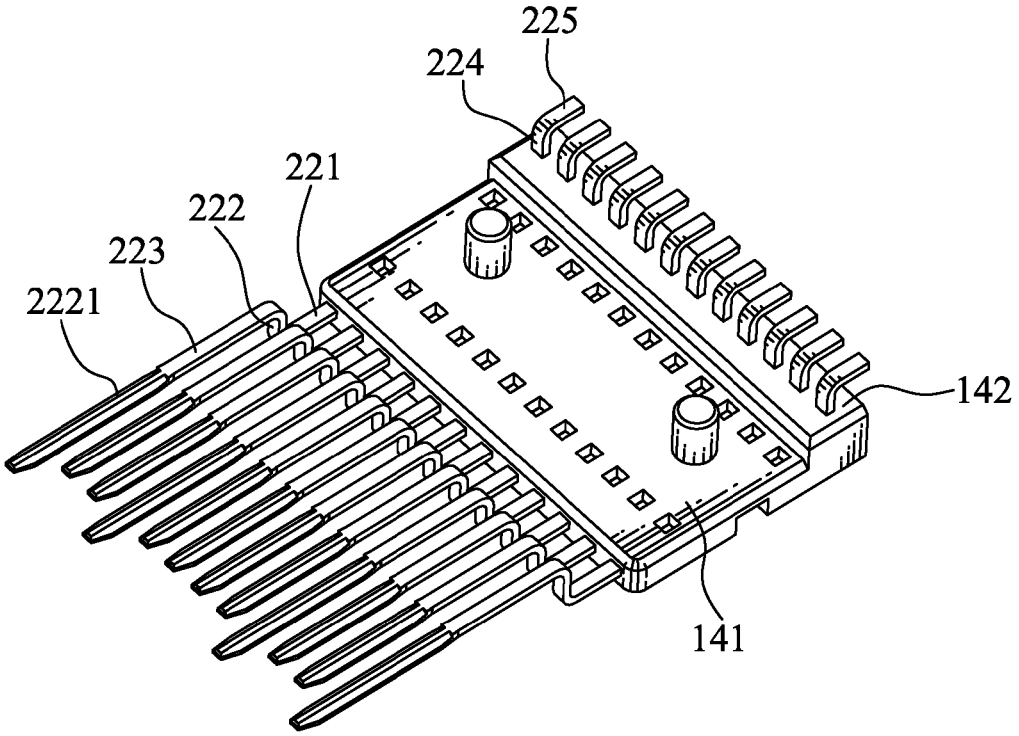
FIG. 7 is a partially perspective view showing that second terminals are molded to a second dielectric body of the electrical connector of FIG. 1.
Figure 8:
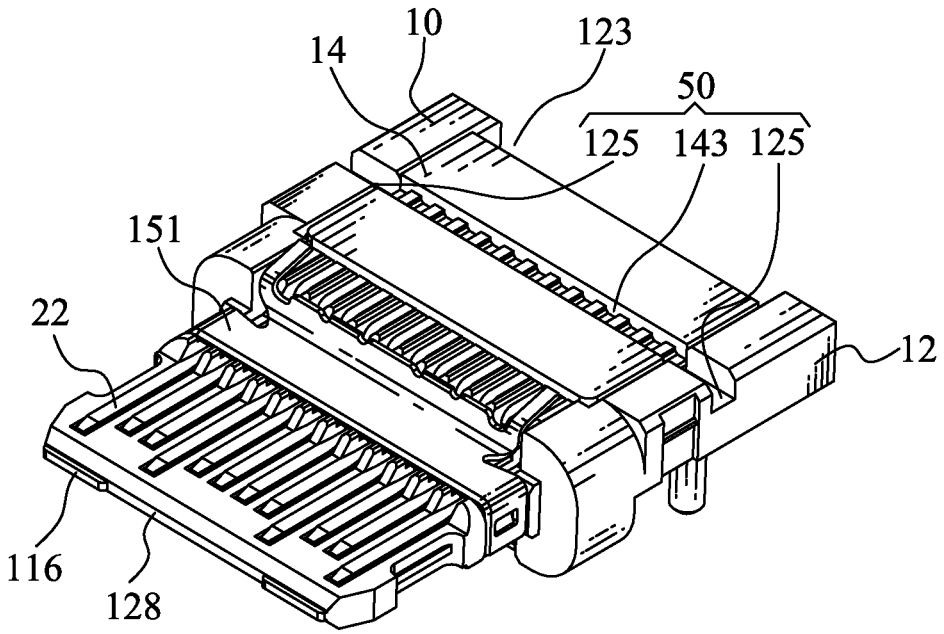
FIG. 8 is a perspective view showing that the electrical connector in accordance with the present invention is without an outer shielding shell and a cover.
Figure 9:
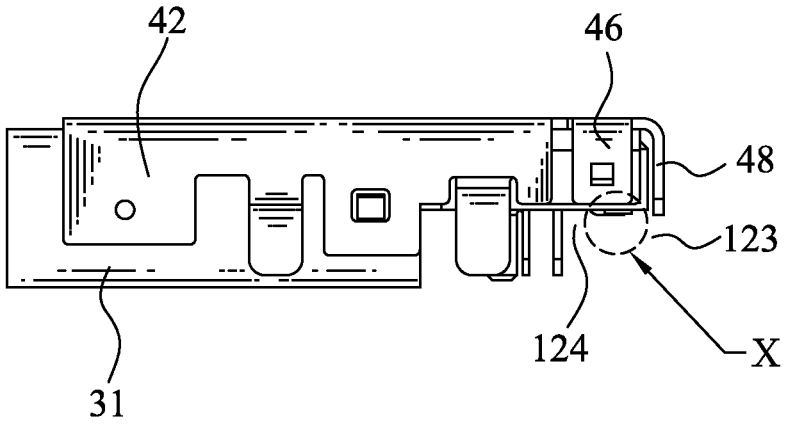
FIG. 9 is a right view of the electrical connector in accordance with the present invention.
Figure 10:
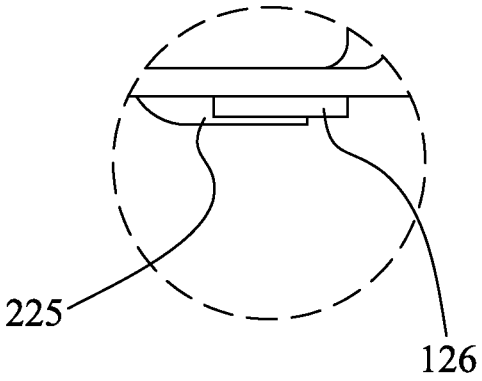
FIG. 10 is an enlarged view of an encircled portion X of the electrical connector of FIG. 9.

Referring to FIG. 3 and FIG. 4, the middle shielding component 11 has a main plate 111, a blocking slice 112 extended downward from a rear edge of the main plate 111, two first soldering arms 113 extended downward from two sides of a bottom edge of the blocking slice 112, a front plate 114 bent downward from a front edge of the main plate 111, a tongue plate 115 extended forward from a bottom edge of the front plate 114, and two abutting pieces 116 extended forward from two sides of a front edge of the tongue plate 115.

Referring to FIG. 3 and FIG. 4, the base body 12 has a base portion 121, a connecting portion 127 extended forward from a middle of a front surface of the base portion 121, and a tongue portion 128 extended forward from a middle of a front surface of the connecting portion 127. The base portion 121 is of a substantially rectangular shape seen from a front view. Two junctions between front ends of a top surface and two side surfaces of the base portion 121 are of arc shapes. Two junctions between rear ends of the top surface and the two side surfaces of the base portion 121 project beyond the two junctions between the front ends of the top surface and the two side surfaces of the base portion 121, so the two junctions between the rear ends of the top surface and the two side surfaces of the base portion 121 are defined as two blocking portions 122. The base portion 121 defines a receiving opening 123 penetrating through a middle of the rear end of the top surface, a middle of a rear end of a bottom surface and a rear surface of the base portion 121. Two opposite sides of a rear end of a bottom of the receiving opening 123 extend oppositely to form two assembling openings 124 respectively penetrating through two opposite sides of the rear end of the bottom surface of the base portion 121.

Two opposite sides of the rear end of the top surface of the base portion 121 are recessed downward to form two first recesses 125 communicating with the receiving opening 123. Top walls of the two assembling openings 124 protrude downward to form two propping portions 126. Two opposite sides of the connecting portion 127 are recessed inward to form two fastening grooves 1271. The base body 12 defines a plurality of first terminal grooves 1291 arranged transversely, and a plurality of second terminal grooves 1292 arranged transversely. Each of the first terminal grooves 1291 penetrates through a bottom surface, a lower portion of a front surface and a lower portion of a rear surface of a front wall of the receiving opening 123 and bottom surfaces of the connecting portion 127 and the tongue portion 128. Each of the second terminal grooves 1292 penetrates through a top surface, an upper portion of the front surface and an upper portion of the rear surface of the front wall of the receiving opening 123 and top surfaces of connecting portion 127 and the tongue portion 128.

Referring to FIG. 3 and FIG. 4, the first dielectric body 13 has a first base board 131, and a first blocking board 132 extended downward from a front of a bottom surface of the first base board 131. The second dielectric body 14 has a second base board 141, and a second blocking board 142 extended downward from a rear of a bottom surface of the second base board 141. The second base board 141 defines a second recess 143 penetrating through middles of a top surface and two opposite side surfaces of the second base board 141.

Referring to FIG. 3, the terminals 20 include a plurality of first terminals 21 and a plurality of second terminals 22. Junctions between front ends of a top surface and two side surfaces of each of the first terminals 21 define two first chamfers 2121. Each of the first terminals 21 has a first fastening arm 211, a first connecting arm 212 extended downward from a front of the first fastening arm 211, a first contact arm 213 extended forward from a bottom of the first connecting arm 212, and a first soldering portion 214 extended downward from a rear of the first fastening arm 211. The first chamfers 2121 are defined at junctions between front ends of a top surface and two side surfaces of the first contact arm 213.

Referring to FIG. 3 and FIG. 4, junctions between front ends of a bottom surface and two side surfaces of each of the second terminals 22 define two second chamfers 2221. Each of the second terminals 22 has a second fastening arm 221, a second connecting arm 222 extended downward from a front of the second fastening arm 221, a second contact arm 223 extended forward from a bottom of the second connecting arm 222, a third connecting arm 224 extended downward from a rear of the second fastening arm 221, and a second soldering arm 225 extended rearward from a bottom of the third connecting arm 224. The second chamfers 2221 are defined at junctions between front ends of a bottom surface and two side surfaces of the second contact arm 223.

Referring to FIG. 3, the outer shielding shell 30 has a bottom plate 313. Two opposite sides of the bottom plate 313 are bent upward to form two lateral plates 312. Two tops of the two lateral plates 312 are bent towards each other and interconnected with each other to form a top plate 311. The outer shielding shell 30 further has a receiving space 31 surrounded among the top plate 311, two lateral plates 312 and the bottom plate 313. Junctions between the two lateral plates 312 and the bottom plate 313 of the outer shielding shell 30 and junctions between the two lateral plates 312 and the top plate 311 of the outer shielding shell 30 are of arc shapes. A middle of a rear edge of the top plate 311 extends rearward to form an extending plate 32. Two opposite sides of a front edge of the extending plate 32 are spaced from the rear edge of the top plate 311 to form two gaps 33. A junction between the top plate 311 and the extending plate 32 defines a rectangular perforation 34. Two portions of the extending plate 32 are punched downward to form two limiting pieces 35. Two opposite sides of the extending plate 32 are bent downward to form two side plates 36. Front ends of bottom edges of the two side plates 36 of the extending plate 32 are extended outward and then are bent downward to form two insertion feet 37. Each of the side plates 36 of the outer shielding shell 30 defines a fastening hole 38.

Figure 11:
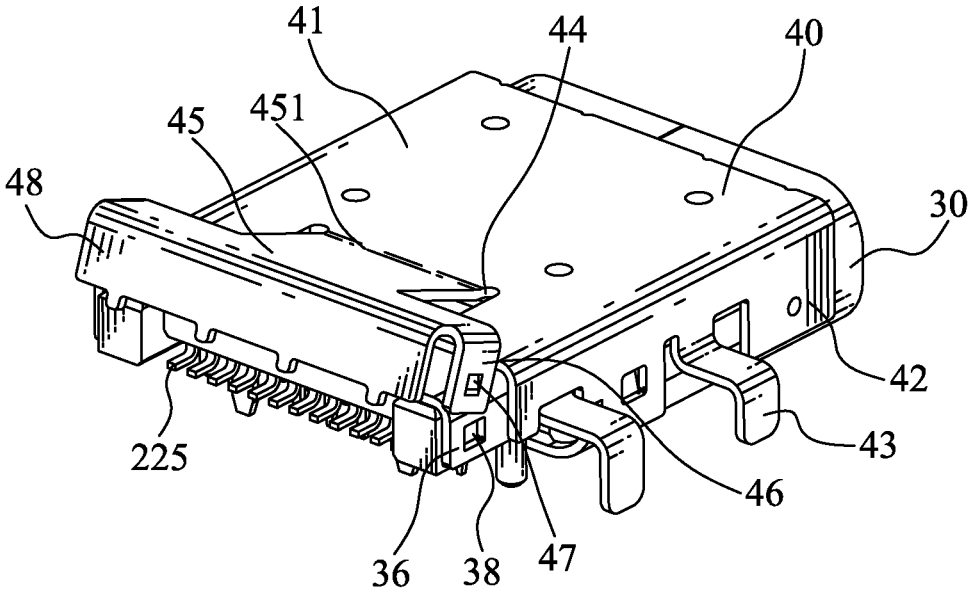
FIG. 11 is a schematic diagram showing that the electrical connector in accordance with the present invention is in a reworking status.
Figure 12:
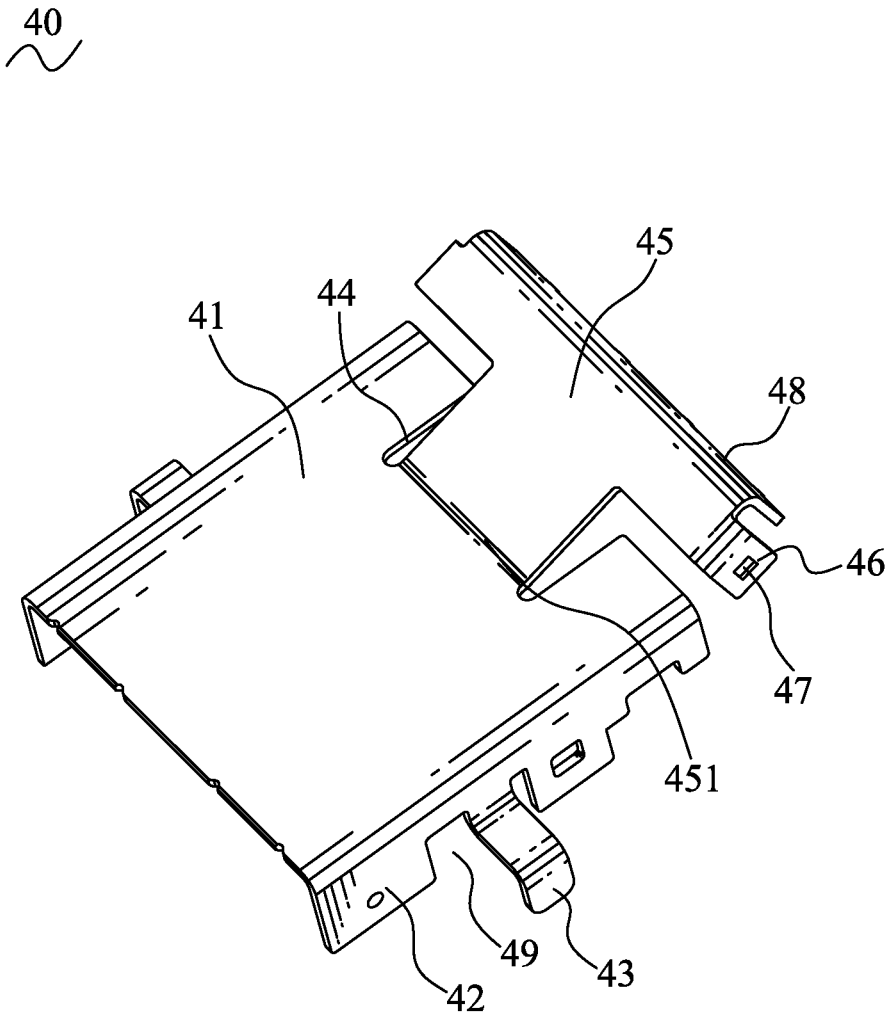
FIG. 12 is a perspective view of the cover of the electrical connector in accordance with the present invention.

Referring to FIG. 4, FIG. 11 and FIG. 12, the cover 40 has a base plate 41, and two first fastening plates 42 bent downward from two opposite sides of the base plate 41. A rear end of the cover 40 defines a T-shaped resilient plate 45 slantwise extending upward and rearward. A middle of a rear edge of the base plate 41 is recessed forward to form a first notch 44. The front wall of the first notch 44 is bent upward and rearward and further extends upward and rearward to form the T-shaped resilient plate 45. The resilient plate 45 has a bending portion 451 connected with the front wall of the first notch 44. Two opposite sides of the resilient plate 45 are bent perpendicular to the resilient plate 45 to form two second fastening plates 46. Each of the second fastening plates 46 is punched inward to form a fastening piece 47. A rear edge of the resilient plate 45 is bent perpendicular to the resilient plate 45 to form a rear plate 48. Bottom edges of the two first fastening plates 42 are recessed upward to form two second notches 49. A top wall of each of the second notches 49 extends downward, then is bent outward and further extends downward to form a soldering feet 43.

Referring to FIG. 3 and FIG. 4, the electrical connector 100 further includes an inner shielding shell 15. The inner shielding shell 15 includes a first inner shielding shell 151 and a second inner shielding shell 152. The first inner shielding shell 151 has a third base plate 1511, two first locating plates 1512 extended upward from two opposite sides of the third base plate 1511, and a first propping plate 1513 bent downward from a rear of the third base plate 1511. Two opposite sides of the first propping plate 1513 slantwise extend downward and rearward to form two first elastic arms 1514. Each of the first locating plates 1512 is punched outward to form a buckling portion 1515. The second inner shielding shell 152 has a fourth base plate 1521, two second locating plates 1522 extended downward from two opposite sides of the fourth base plate 1521, and a second propping plate 1523 bent upward from a rear of the fourth base plate 1521. Two opposite sides of the second propping plate 1523 slantwise extend upward and rearward to form two second elastic arms 1524. Each of the second locating plates 1522 defines a buckling hole 1525.

Referring to FIG. 1 to FIG. 12, the middle shielding component 11 is integrally molded to the base body 12. Two opposite sides of the main plate 111, two opposite sides of the blocking slice 112, the front plate 114 and a rear end of the tongue plate 115 are molded in the base portion 121. A front end of the tongue plate 115 and rear ends of the two abutting pieces 116 are molded in the connecting portion 127 and the tongue portion 128. Front ends of the abutting pieces 116 project beyond a front surface of the tongue portion 128. A middle of the main plate 111, a middle of the blocking slice 112 and the first soldering arms 113 are received in the receiving opening 123. The first soldering arms 113 are mounted to the circuit board.

The main body 10 is mounted to the circuit board. One end of the circuit board is assembled to the receiving opening 123 and the assembling openings 124. The terminals 20 are fastened to the main body 10 and are arranged transversely. Rear ends of the terminals 20 project into the receiving opening 123 and are mounted to the circuit board. Front ends of the terminals 20 are exposed out of the main body 10. Specifically, the first terminals 21 are fastened to the first dielectric body 13 and are arranged transversely. Front ends of the first terminals 21 project beyond a front surface of the first dielectric body 13. Rear ends of the first terminals 21 project beyond a bottom surface of the first dielectric body 13. The first dielectric body 13 is fastened to a front of the receiving opening 123 and is located under the main plate 111. The rear ends of the first terminals 21 are located in front of the blocking slice 112 and project into the receiving opening 123. The front ends of the first terminals 21 are fastened to the base portion 121, the connecting portion 127 and the tongue portion 128, and are exposed beyond a bottom surface of the tongue portion 128.

The first base board 131 is fastened to the front of the receiving opening 123. A rear surface of the first base board 131 abuts against a front surface of the blocking slice 112. A front surface of the first blocking board 132 abuts against the front wall of the receiving opening 123. A rear surface of the first blocking board 132 is flush with the rear surface of the front wall of the receiving opening 123. The first fastening arm 211 is fastened to the first base board 131. The first connecting arm 212 is fastened in the first blocking board 132. The first contact arm 213 projects beyond a front surface of the first blocking board 132 and is fastened to one of the first terminal grooves 1291. A front end of the first contact arm 213 is exposed beyond the bottom surface of the tongue portion 128. A top end of the first soldering portion 214 is fastened in the first base board 131. A bottom end of the first soldering portion 214 projects beyond the bottom surface of the first base board 131. The first soldering portion 214 projects into the receiving opening 123 to be soldered on the circuit board. The first soldering portions 214 of the first terminals 21 are arranged in two rows. The first soldering portions 214 of the first terminals 21 arranged in each row are arranged transversely.

The second terminals 22 are fastened to the second dielectric body 14 and are arranged transversely. Front ends of the second terminals 22 project beyond a front surface of the second dielectric body 14. Rear ends of the second terminals 22 project beyond a bottom surface of the second dielectric body 14. The second dielectric body 14 is fastened to the receiving opening 123 and is located above the main plate 111. The rear ends of the second terminals 22 are located behind the blocking slice 112 and project into the receiving opening 123. The front ends of the second terminals 22 are fastened to the base portion 121, the connecting portion 127 and the tongue portion 128, and are exposed beyond a top surface of the tongue portion 128.

The second base board 141 is fastened to the receiving opening 123 and is located above the main plate 111. The second blocking board 142 is fastened to a rear of the receiving opening 123. A front surface of the second blocking board 142 abuts against a rear surface of the blocking slice 112. The second recess 143 is corresponding to and communicated with the first recesses 125, so the second recess 143 and the first recesses 125 together form a limiting groove 50. A rear end of the second fastening arm 221 and a top end of the third connecting arm 224 are fastened to the second base board 141. A front end of the second fastening arm 221, the second connecting arm 222 and the second contact arm 223 project beyond a front surface of the second base board 141 and are fastened to one of the second terminal grooves 1292. The second contact arm 223 is exposed beyond the top surface of the tongue portion 128. A bottom end of the third connecting arm 224 and the second soldering arm 225 project beyond a bottom surface of the second blocking board 142. The second soldering arm 225 projects into the receiving opening 123 and projects beyond bottom surfaces of the propping portions 126 to be soldered to the circuit board. The bottom surfaces of the propping portions 126 abut against a top surface of the circuit board and the second soldering arm 225 projects beyond the bottom surfaces of the propping portions 126 so as to ensure that the second soldering arm 225 is soldered to a bonding pad (not shown) of the circuit board.

The inner shielding shell 15 encloses the connecting portion 127 and rear ends of the first contact arm 213 and the second contact arm 223. Specifically, the third base plate 1511 is located at a bottom surface of the connecting portion 127. The two first locating plates 1512 are fastened in the fastening grooves 1271. The first propping plate 1513 abuts against the lower portion of the front surface of the front wall of the receiving opening 123. The fourth base plate 1521 is located at a top surface of the connecting portion 127. The two second locating plates 1522 are fastened in the fastening grooves 1271 and are attached to the first locating plates 1512. The buckling portion 1515 is buckled in the buckling hole 1525. The second propping plate 1523 abuts against the upper portion of the front surface of the front wall of the receiving opening 123.

The outer shielding shell 30 surrounds the main body 10 together with the terminals 20 and the inner shielding shell 15. A front end of the main body 10 is received in the receiving space 31. The front end of the main body 10 is spaced from an inner surface of a front end of the outer shielding shell 30 to form an insertion space 60 between the front end of the main body 10 and the front end of the outer shielding shell 30. Specifically, a front end of the base portion 121 is inserted into the front end of the outer shielding shell 30. The insertion space 60 is formed among the front end of the base portion 121, the connecting portion 127, the tongue portion 128 and the front end of the outer shielding shell 30. The first elastic arms 1514 and the second elastic arms 1524 elastically abut against the bottom plate 313 and the top plate 311. Rear surfaces of the two lateral plates 312 of the outer shielding shell 30 respectively abut against the two blocking portions 122. The extending plate 32 is disposed on a top surface of a rear end of the main body 10. The extending plate 32 is disposed on the rear end of the top surface of the base portion 121 and the top surface of the second base board 141 of the second dielectric body 14. The two limiting pieces 35 are limited in two opposite sides of the limiting groove 50 for preventing the outer shielding shell 30 from moving forward.

The two side plates 36 are fastened to the rear ends of the two side surfaces of the base portion 121. The insertion feet 37 are mounted to the circuit board.

The cover 40 is covered outside the outer shielding shell 30. The cover 40 is covered on the top plate 311 of the outer shielding shell 30. The resilient plate 45 is separably mounted to an outside of the outer shielding shell 30 to make the rear plate 48 disposed behind or above the main body 10 and the outer shielding shell 30. Specifically, the base plate 41 is mounted on a top surface of the top plate 311 and two opposite sides of a front end of a top surface of the extending plate 32. The two first fastening plates 42 are respectively fastened to two outer surfaces of the two lateral plates 312 of the outer shielding shell 30 and front ends of outer surfaces of the two side plates 36 of the outer shielding shell 30. The soldering feet 43 are located in front of the insertion feet 37. The soldering feet 43 is mounted to the circuit board. The bending portion 451 of the resilient plate 45 is located over the perforation 34. The resilient plate 45 is disposed on a rear end and a middle of the front end of the top surface of the extending plate 32. The rear plate 48 is disposed behind the main body 10 and the outer shielding shell 30. The second fastening plates 46 are attached to rear ends of the outer surfaces of the two side plates 36 of the outer shielding shell 30. The rear plate 48 is disposed behind the rear surface of the base portion 121, a rear surface of the extending plate 32 and rear surfaces of the two side plates 36. The fastening piece 47 is fastened to the fastening hole 38.

When the second terminals 22 are soldered to the circuit board by a surface mount technology (SMT), if a soldering problem of the electrical connector 100 is generated, the second fastening plates 46 are respectively pulled away from the two side plates 36 to make the fastening piece 47 break away from the fastening hole 38. The resilient plate 45 is tilted upward by virtue of an elastic force, the rear plate 48 moves upward to be located above the rear surfaces of the base portion 121, the extending plate 32 and the two side plates 36, so that the electrical connector 100 is capable of being reworked. The bending portion 451 of the resilient plate 45 is located over the perforation 34 to ensure a flatness between the cover 40 and the outer shielding shell 30 after the cover 40 is covered on the outer shielding shell 30. The junctions between the front ends of the top surface and the two side surfaces of each of the first terminals 21 define the first chamfers 2121, and the junctions between the front ends of the bottom surface and the two side surfaces of each of the second terminals 22 define the second chamfers 2221 to improve a differential effect impedance so as to improve a transmission quality of electrical signals of the first terminals 21 and the second terminals 22. The front ends of the abutting pieces 116 project beyond the front surface of the tongue portion 128. When a small foreign matter is located at the front surface of the tongue portion 128, the front ends of the abutting pieces 116 are capable of preventing the tongue portion 128 from being damaged when the electrical connector 100 is interconnected with a docking connector (not shown). An insertion portion (not shown) of the docking connector is inserted into the insertion space 60 of the electrical connector 100.

As described above, the cover 40 is covered outside the outer shielding shell 30, the rear end of the cover 40 defines the resilient plate 45 slantwise extending upward and rearward, and the rear plate 48 is disposed behind the main body 10 and the outer shielding shell 30, if the soldering problem of the electrical connector 100 is generated, the resilient plate 45 is tilted upward by virtue of the elastic force, the rear plate 48 moves upward to be located above the main body 10 and the outer shielding shell 30, so that the electrical connector 100 is capable of being reworked. As a result, a defect rate of the electrical connector 100 is lower and a manufacturing cost of the electrical connector 100 is decreased.

What is claimed is:

1. An electrical connector for being mounted to a circuit board, comprising:

a main body mounted to the circuit board;

a plurality of terminals fastened to the main body and arranged transversely, rear ends of the terminals being mounted to the circuit board, and front ends of the terminals being exposed out of the main body;

an outer shielding shell surrounding the main body together with the terminals, a front end of the main body being spaced from an inner surface of a front end of the outer shielding shell to form an insertion space between the front end of the main body and the front end of the outer shielding shell; and a cover covered outside the outer shielding shell, a rear end of the cover defining a resilient plate slantwise extending upward and rearward, a rear edge of the resilient plate bent perpendicular to the resilient plate to form a rear plate, the resilient plate being separably mounted to an outside of the outer shielding shell to make the rear plate disposed behind or above the main body and the outer shielding shell.

2. The electrical connector as claimed in claim 1, wherein the main body includes a base body which has a base portion, the base portion defines a receiving opening penetrating through a middle of a rear end of a top surface, a middle of a rear end of a bottom surface and a rear surface of the base portion, two opposite sides of a rear end of a bottom of the receiving opening extend oppositely to form two assembling openings respectively penetrating through two opposite sides of the rear end of the bottom surface of the base portion, one end of the circuit board is assembled to the receiving opening and the assembling openings, the rear ends of the terminals project into the receiving opening.

3. The electrical connector as claimed in claim 1, wherein the outer shielding shell has a bottom plate, two lateral plates, a top plate and a receiving space surrounded among the top plate, two lateral plates and the bottom plate, a middle of a rear edge of the top plate extends rearward to form an extending plate, the cover has a base plate, a middle of a rear edge of the base plate is recessed forward to form a first notch, the front wall of the first notch is bent upward and rearward and further extends upward and rearward to form the T-shaped resilient plate, a front end of the main body is received in the receiving space, the extending plate is disposed on a top surface of a rear end of the main body, the base plate is mounted on a top surface of the top plate and two opposite sides of a front end of a top surface of the extending plate, the resilient plate is disposed on a rear end and a middle of the front end of the top surface of the extending plate.

4. The electrical connector as claimed in claim 3, wherein a junction between the top plate and the extending plate defines a perforation, the resilient plate has a bending portion connected with the front wall of the first notch, the bending portion of the resilient plate is located over the perforation.

5. The electrical connector as claimed in claim 3, wherein two opposite sides of the extending plate are bent downward to form two side plates, the cover has two first fastening plates bent downward from two opposite sides of the base plate, two opposite sides of the resilient plate are bent perpendicular to the resilient plate to form two second fastening plates, the two first fastening plates are respectively fastened to two outer surfaces of the two lateral plates of the outer shielding shell and front ends of outer surfaces of the two side plates of the outer shielding shell, the second fastening plates are attached to rear ends of the outer surfaces of the two side plates of the outer shielding shell.

6. The electrical connector as claimed in claim 5, wherein each of the side plates of the outer shielding shell defines a fastening hole, each of the second fastening plates is punched inward to form a fastening piece, the fastening piece is fastened to the fastening hole.

7. The electrical connector as claimed in claim 3, wherein the main body includes a base body which has a base portion, a connecting portion extended forward from a middle of a front surface of the base portion, and a tongue portion extended forward from a middle of a front surface of the connecting portion, a front end of the base portion is inserted into the front end of the outer shielding shell, the insertion space is formed among the front end of the base portion, the connecting portion, the tongue portion and the front end of the outer shielding shell.

8. The electrical connector as claimed in claim 7, wherein two junctions between rear ends of a top surface and two side surfaces of the base portion project beyond two junctions between front ends of the top surface and the two side surfaces of the base portion, so the two junctions between the rear ends of the top surface and the two side surfaces of the base portion are defined as two blocking portions, rear surfaces of the two lateral plates of the outer shielding shell respectively abut against the two blocking portions.

9. The electrical connector as claimed in claim 7, wherein the main body further includes a middle shielding component, the middle shielding component has a main plate, a blocking slice extended downward from a rear edge of the main plate, a front plate bent downward from a front edge of the main plate, a tongue plate extended forward from a bottom edge of the front plate, and two abutting pieces extended forward from two sides of a front edge of the tongue plate, the middle shielding component is integrally molded to the base body, two opposite sides of the main plate, two opposite sides of the blocking slice, the front plate and a rear end of the tongue plate are molded in the base portion, a front end of the tongue plate and rear ends of the two abutting pieces are molded in the connecting portion and the tongue portion, front ends of the abutting pieces project beyond a front surface of the tongue portion.

10. The electrical connector as claimed in claim 9, wherein the base portion defines a receiving opening penetrating through a middle of the rear end of the top surface, a middle of a rear end of a bottom surface and a rear surface of the base portion, the middle shielding component has two first soldering arms extended downward from two sides of a bottom edge of the blocking slice, a middle of the main plate, a middle of the blocking slice and the first soldering arms are received in the receiving opening, the first soldering arms are mounted to the circuit board.

11. The electrical connector as claimed in claim 10, wherein the main body includes a first dielectric body, the terminals include a plurality of first terminals fastened to the first dielectric body and are arranged transversely, front ends of the first terminals project beyond a front surface of the first dielectric body, rear ends of the first terminals project beyond a bottom surface of the first dielectric body, the first dielectric body is fastened to a front of the receiving opening and is located under the main plate, the rear ends of the first terminals are located in front of the blocking slice and project into the receiving opening, the front ends of the first terminals are fastened to the base portion, the connecting portion and the tongue portion, and are exposed beyond a bottom surface of the tongue portion.

12. The electrical connector as claimed in claim 11, wherein junctions between front ends of a top surface and two side surfaces of each of the first terminals define two first chamfers.

13. The electrical connector as claimed in claim 10, wherein the main body includes a second dielectric body, the terminals include a plurality of second terminals fastened to the second dielectric body and are arranged transversely, front ends of the second terminals project beyond a front surface of the second dielectric body, rear ends of the second terminals project beyond a bottom surface of the second dielectric body, the second dielectric body is fastened to the receiving opening and is located above the main plate, the rear ends of the second terminals are located behind the blocking slice and project into the receiving opening, the front ends of the second terminals are fastened to the base portion, the connecting portion and the tongue portion, and are exposed beyond a top surface of the tongue portion.

14. The electrical connector as claimed in claim 13, wherein junctions between front ends of a bottom surface and two side surfaces of each of the second terminals define two second chamfers.

15. The electrical connector as claimed in claim 13, wherein the second dielectric body has a second base board, the extending plate is disposed on a rear end of a top surface of the base portion and a top surface of the second base board of the second dielectric body.

16. The electrical connector as claimed in claim 15, wherein two opposite sides of the rear end of the top surface of the base portion are recessed downward to form two first recesses, the second base board defines a second recess penetrating through middles of a top surface and two opposite side surfaces of the second base board, the second recess is corresponding to and communicated with the first recesses, so the second recess and the first recesses together form a limiting groove, two portions of the extending plate are punched downward to form two limiting pieces, the two limiting pieces are limited in two opposite sides of the limiting groove.

17. The electrical connector as claimed in claim 3, wherein junctions between the two lateral plates and the bottom plate of the outer shielding shell and junctions between the two lateral plates and the top plate of the outer shielding shell are of arc shapes.

* * * * *